US011193347B2

(12) United States Patent
Smith et al.

(10) Patent No.: US 11,193,347 B2
(45) Date of Patent: Dec. 7, 2021

(54) SLIP INSERT FOR TOOL RETENTION

(71) Applicant: PetroQuip Energy Services, LLP, Waller, TX (US)

(72) Inventors: Roddie R. Smith, Katy, TX (US); Robert Joe Coon, Missouri City, TX (US)

(73) Assignee: PETROQUIP ENERGY SERVICES, LLP, Waller, TX (US)

( * ) Notice: Subject to any disclaimer, the term of this patent is extended or adjusted under 35 U.S.C. 154(b) by 85 days.

(21) Appl. No.: 16/592,490

(22) Filed: Oct. 3, 2019

(65) Prior Publication Data

US 2020/0141207 A1 May 7, 2020

Related U.S. Application Data

(60) Provisional application No. 62/756,824, filed on Nov. 7, 2018.

(51) Int. Cl.

| | |
|---|---|
| ***E21B 33/129*** | (2006.01) |
| ***E21B 23/01*** | (2006.01) |
| *E21B 43/26* | (2006.01) |

(52) U.S. Cl.

CPC ..... *E21B 33/129* (2013.01); *E21B 23/01* (2013.01); *E21B 43/26* (2013.01)

(58) Field of Classification Search

CPC ..... E21B 33/192; E21B 33/1291; E21B 33/1292; E21B 33/1293; E21B 23/01

See application file for complete search history.

(56) References Cited

U.S. PATENT DOCUMENTS

| | | | |
|---|---|---|---|
| 2,921,632 | A | 1/1906 | Clark, Jr. |
| 2,989,087 | A | 6/1961 | Higgins |
| 3,000,443 | A | 9/1961 | Thompson |
| 3,051,243 | A | 8/1962 | Grimmer et al. |
| 3,090,442 | A | 5/1963 | Cochran |
| 3,151,681 | A | 10/1964 | Cochran |
| 3,166,128 | A | 1/1965 | Myers et al. |
| 3,298,440 | A | 1/1967 | Current |
| 3,358,766 | A | 12/1967 | Current |
| 3,845,815 | A | 11/1974 | Garwood |
| 3,939,519 | A | 2/1976 | Muirhead |

(Continued)

FOREIGN PATENT DOCUMENTS

| | | | |
|---|---|---|---|
| CA | 2810045 A1 | 9/2013 | |
| CA | 2894749 A1 * | 12/2015 | ..... E21B 33/129 |

(Continued)

OTHER PUBLICATIONS

PCT/US2017/036252—International Search Report and Written Opinion of the International Searching Authority, dated Sep. 21, 2017, 20 pages.

(Continued)

*Primary Examiner* — Frederick L Lagman
(74) *Attorney, Agent, or Firm* — Nolte Lackenbach Siegel

(57) ABSTRACT

A slip insert is provided. The slip insert may include a concave surface formed therein. An edge can be formed between a first two-dimensional planer surface and the concave surface. The slip insert may include an edge formed between an intersection of a first two-dimensional planer surface and a second two-dimensional planer surface extending form the concave surface.

20 Claims, 10 Drawing Sheets

(56) References Cited

U.S. PATENT DOCUMENTS 4,114,694 A 9/1978 Dinning
4,176,715 A 12/1979 Bigelow
4,436,152 A 3/1984 Fisher, Jr. et al.
4,487,221 A 12/1984 Zwart
4,510,994 A 4/1985 Pringle
4,730,835 A 3/1988 Wilcox
4,765,404 A 8/1988 Bailey
4,784,226 A 11/1988 Wyatt
4,896,721 A 1/1990 Welch
4,901,794 A 2/1990 Baugh
4,903,777 A 2/1990 Jordan, Jr.
4,917,191 A 4/1990 Hopmann et al.
4,934,452 A 6/1990 Bradley
5,012,867 A 5/1991 Kilgore et al.
5,131,468 A * 7/1992 Lane ..... E21B 33/122 166/120
5,156,220 A 10/1992 Forehand et al.
5,174,379 A 12/1992 Whitely et al.
5,183,114 A 2/1993 Mashaw et al.
5,263,683 A 11/1993 Wong
5,305,828 A 4/1994 White et al.
5,305,833 A 4/1994 Collins
5,309,993 A 5/1994 Coon et al.
5,316,084 A 5/1994 Murray et al.
5,390,736 A 2/1995 Budde
5,511,617 A 4/1996 Snider et al.
5,542,473 A 8/1996 Pringle
5,549,161 A 8/1996 Gomez et al.
5,641,023 A 6/1997 Ross et al.
5,678,633 A 10/1997 Constantine, Jr.
5,826,652 A 10/1998 Tapp
5,921,318 A 7/1999 Ross
5,927,402 A 7/1999 Benson et al.
5,960,879 A 10/1999 Echols
5,967,816 A 10/1999 Sampa et al.
6,167,963 B1 * 1/2001 McMahan ..... E21B 33/1204 166/179
6,189,619 B1 2/2001 Wyatt et al.
6,224,112 B1 5/2001 Eriksen et al.
6,237,686 B1 5/2001 Ryll et al.
6,302,217 B1 10/2001 Kilgore et al.
6,318,729 B1 11/2001 Pitts, Jr. et al.
6,561,270 B1 5/2003 Budde
6,631,768 B2 10/2003 Patel et al.
6,722,439 B2 4/2004 Garay et al.
6,793,022 B2 * 9/2004 Vick ..... E21B 33/1208 166/118
6,866,100 B2 3/2005 Gudmedstad et al.
6,976,534 B2 * 12/2005 Sutton ..... E21B 33/129 166/118
6,983,796 B2 1/2006 Bayne et al.
7,036,397 B2 * 5/2006 Bangert ..... E21B 19/07 81/57.15
7,191,843 B2 3/2007 Wong
7,472,753 B2 1/2009 Mondelli et al.
7,779,906 B2 * 8/2010 Porter ..... E21B 33/129 166/134
7,921,922 B2 4/2011 Darnell et al.
8,079,413 B2 12/2011 Frazier
8,336,616 B1 12/2012 McClinton
8,899,335 B2 12/2014 Churchill
8,955,605 B2 * 2/2015 VanLue ..... E21B 34/06 166/382
9,133,698 B2 9/2015 Myers et al.
9,309,733 B2 4/2016 Xu
9,657,547 B2 5/2017 Raggio
9,677,356 B2 * 6/2017 Rochen ..... E21B 23/01
9,725,981 B2 * 8/2017 Young ..... E21B 33/1291
9,835,003 B2 12/2017 Harris et al.
9,845,658 B1 12/2017 Nish et al.
9,976,379 B2 5/2018 Schmidt et al.
10,000,991 B2 6/2018 Harris
10,053,945 B2 8/2018 Acosta et al.
10,309,189 B1 6/2019 Branton
2003/0056951 A1 3/2003 Kaszuba
2004/0104025 A1 6/2004 Mikolajczyk
2005/0199401 A1 9/2005 Patel
2006/0237186 A1 10/2006 Mondelli et al.
2007/0175631 A1 * 8/2007 O'Brien ..... E21B 23/01 166/217
2008/0169105 A1 7/2008 Williamson et al.
2008/0217000 A1 9/2008 Palmer et al.
2008/0308266 A1 12/2008 Roberts et al.
2009/0025930 A1 1/2009 Iblings et al.
2009/0044957 A1 2/2009 Clayton
2010/0051293 A1 3/2010 Ezell et al.
2010/0132960 A1 6/2010 Shkurti et al.
2011/0088891 A1 4/2011 Stout
2011/0115168 A1 5/2011 Miller et al.
2011/0147015 A1 6/2011 Mickey
2011/0180273 A1 7/2011 Hughes et al.
2011/0259610 A1 10/2011 Shkurti et al.
2012/0097384 A1 * 4/2012 Valencia ..... E21B 33/1204 166/134
2012/0267099 A1 10/2012 Simson et al.
2013/0186647 A1 7/2013 Xu et al.
2013/0192853 A1 8/2013 Themig et al.
2013/0240203 A1 9/2013 Frazier
2014/0124192 A1 5/2014 Robinson
2014/0216754 A1 8/2014 Richard et al.
2014/0224479 A1 8/2014 Andrigo
2015/0021012 A1 1/2015 Gerrard
2015/0075774 A1 3/2015 Raggio
2015/0247376 A1 9/2015 Tolman et al.
2015/0308215 A1 10/2015 Kellner et al.
2015/0361756 A1 12/2015 Frazier
2016/0061001 A1 3/2016 Fitzhugh et al.
2016/0186511 A1 6/2016 Corondado et al.
2016/0208575 A1 7/2016 Bellavance et al.
2016/0222755 A1 8/2016 Angman
2016/0251937 A1 9/2016 Fripp
2016/0305215 A1 10/2016 Harris et al.
2016/0376869 A1 12/2016 Holdings
2017/0022780 A1 1/2017 Berry
2017/0145781 A1 5/2017 Silva
2017/0158942 A1 6/2017 Okura et al.
2017/0191340 A1 7/2017 Deng
2017/0218722 A1 8/2017 Gordon et al.
2017/0260824 A1 * 9/2017 Kellner ..... B22F 7/06
2017/0268310 A1 9/2017 Shkurti
2017/0268311 A1 * 9/2017 Tse ..... E21B 33/1291
2017/0356268 A1 12/2017 Smith et al.
2017/0362912 A1 12/2017 Smith et al.
2017/0370176 A1 12/2017 Frazier
2018/0016864 A1 1/2018 Parekh et al.
2018/0023362 A1 1/2018 Makowiecki et al.
2018/0051532 A1 2/2018 Smith et al.
2018/0128074 A1 5/2018 Frazier
2018/0135380 A1 5/2018 Saulou et al.
2018/0171745 A1 6/2018 Jones
2018/0171746 A1 6/2018 Dudzinski et al.
2018/0328130 A1 11/2018 Smith et al.
2018/0328136 A1 11/2018 Smith et al.
2018/0328137 A1 11/2018 Smith et al.
2019/0024498 A1 1/2019 Coon et al.

FOREIGN PATENT DOCUMENTS

WO 2012-045168 A1 4/2012
WO 2017-218321 A1 9/2013
WO 2015-076831 A1 4/2016
WO 2016-065291 A1 12/2017

OTHER PUBLICATIONS

PCT/US2017/036692—International Search Report and Written Opinion of he International Searching Authority, dated Jun. 9, 2017, 17 pages.

PCT/US2017/036729—International Search Report and Written Opinion of he International Searching Authority, dated Jun. 9, 2017, 17 pages.

(56) References Cited

OTHER PUBLICATIONS

PCT/US2017/036736—International Search Report and Written Opinion of he International Searching Authority, dated Jun. 9, 2017, 16 pages.
PCT/US2017/036742—International Search Report and Written Opinion of he International Searching Authority, dated Jun. 9, 2017, 18 pages.
PCT/US2018/045777—International Search Report and Written Opinion of the International Searching Authority, dated Nov. 22, 2018, 15 pages.

* cited by examiner

SLIP INSERT FOR TOOL RETENTION

CROSS-REFERENCE TO RELATED APPLICATIONS

This application claims the benefit of U.S. Provisional Patent Application having Ser. No. 62/756,824, which was filed Nov. 7, 2018. The aforementioned patent application is hereby incorporated by reference in its entirety into the present application to the extent consistent with the present application.

BACKGROUND

Slips are used for various downhole tools, such as bridge plugs, fracture plugs, other plugs, and packers. The slips can have inserts to grip the inner wall of a casing or tubular. FIG. 1 depicts a section view of a prior art slip 101 with inserts 105 installed therein. The inserts 105 are shown installed at an angle 110. The angle 110 can be equal to from about 0 degrees to 40 degrees or greater. FIG. 2 depicts an orthographic view of the prior art insert 105. The prior art insert 105 is a cylindrically shaped insert and includes a first two-dimensional planar surface 210 intersecting a second two-dimensional planar surface 220 forming an edge 230. Inserts for slips on metallic and non-metallic tools, such as composite plugs, packers, etc., must be able to engage with the casing to stop the tools from moving during their operation. When a slip is actuated to engage a casing wall, conventional inserts 105 press into the casing. When pressed against the inner wall of the casing, the edge 230 can impinge the casing and assist in securing the downhole tool into a given position within the wellbore. When conventional inserts 105 are used, the overall securing performance within the casing of the slip and associated downhole tool can be less than desired and the downhole tool can move during operations.

There is a need, therefore, for improved downhole tools, systems and methods for securing downhole tools into desired locations.

SUMMARY

Embodiments of the disclosure may provide a slip insert secured to a slip segment. The slip insert may include a concave surface formed therein. The slip insert may include an edge formed between the intersection of a first two-dimensional planar surface and the concave surface. The slip insert may include an edge formed between an intersection of a first two-dimensional planar surface and a second two-dimensional planar surface extending form the concave surface.

Embodiments of the disclosure may further provide a downhole tool that can include a first slip that can include one or more first slip segments disposed about one or more first tapered surfaces on an outer surface of the downhole tool and one or more slip inserts can be secured to at least one of the first slip segments, the slip inserts can include a concave surface formed therein. The downhole tool can include a second slip that can include one or more second slip segments disposed about one or more second tapered surfaces on the outer surface of the downhole tools and one or more slip inserts secured to at least one of the second slip segments, where the slip inserts can have a concave surface formed therein. The one or more slip inserts can include an edge formed between an intersection of a first two-dimensional planar surface and a second two-dimensional planar surface extending from the concave surface.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features can be arbitrarily increased or reduced for clarity of discussion.

FIGS. 12A-12C illustrate another embodiment of a slip in which FIG. 12A is a perspective view and FIG. 12B a sectioned view while FIG. 12C depicts an insert in isolation from the rest of the slip.

DETAILED DESCRIPTION

Figure 1:
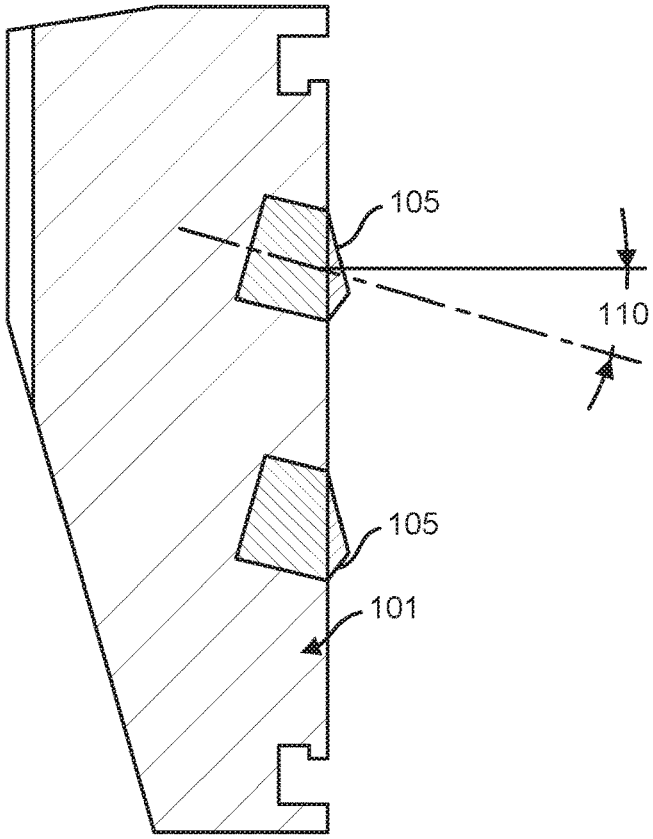
Prior Art FIG. 1
FIG. 1 depicts a section view of a prior art slip with inserts installed therein.
Figure 2:
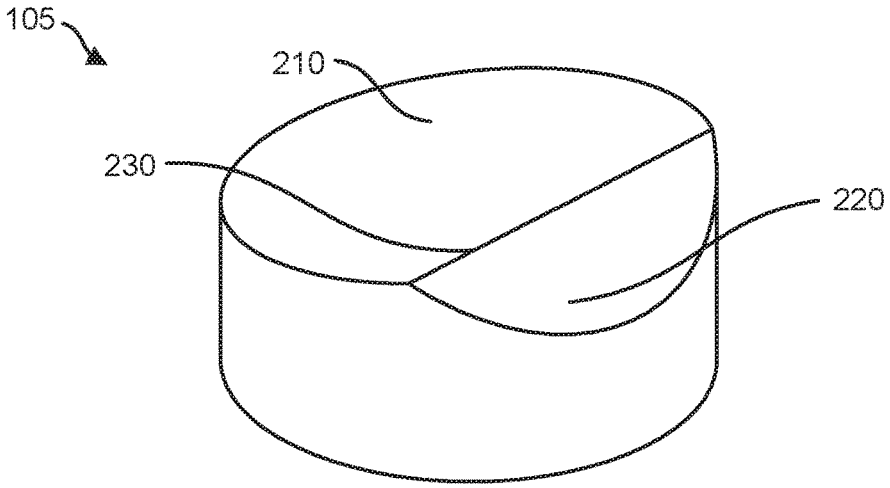
Prior Art FIG. 2
FIG. 2 depicts an orthographic view of the prior art insert.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features can be formed interposing the first and second features, such that the first and second features may not be in direct contact. Finally, the exemplary embodiments presented below can be combined in any combination of ways, i.e., any element from one exemplary embodiment can be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure can be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 3:
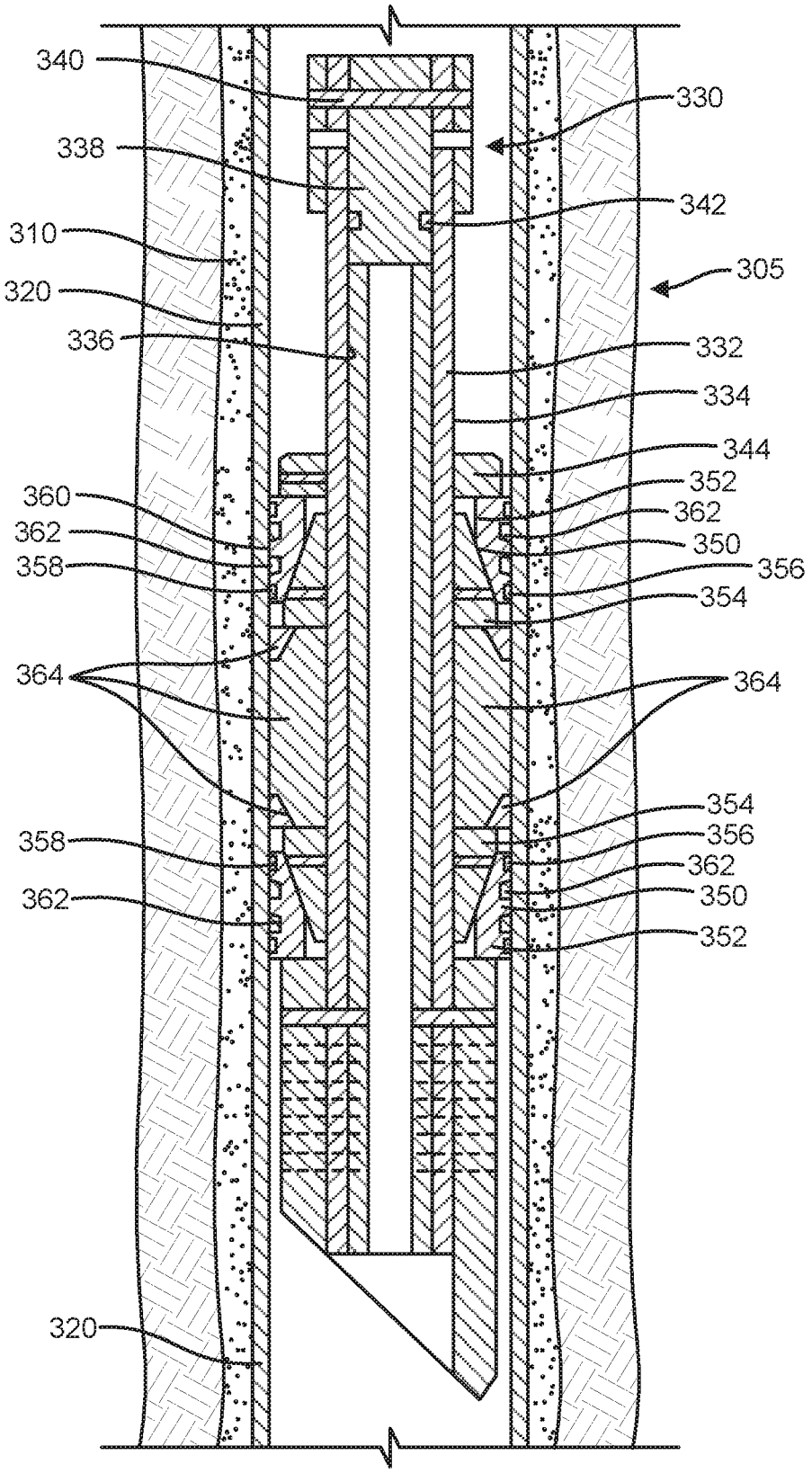
FIG. 3 depicts a tool within a wellbore, according to one or more embodiments disclosed.

FIG. 3 depicts a downhole tool 330 within a wellbore 310, according to one or more embodiments disclosed. A well 305 includes a wellbore 310 with a casing 320 secured therein. In one or more embodiments, downhole tool 330 can include an outer surface 334. The downhole tool 330 can include a mandrel 332 with an outer surface 334 and an inner surface 336. The downhole tool 330 can be a downhole packer, frac plug, bridge plug, or other downhole tool that can be secured within a casing or wellbore utilizing one or more slips 352 or other casing attachment configuration. Downhole tool 330 has an optional plug 338 pinned within mandrel 332 by radially oriented pin 340. Plug 338 can have a seal 342 located between plug 338 and mandrel 332. The overall structure would be suited for use as and referred to simply as a packer if plug 338 were not incorporated and fluid communication were allowed through the downhole tool 330. Other components can be connected so that the packer, without plug 338, can be used, for example, as a frac plug.

A spacer ring 344 can be mounted to the mandrel 332. A first slip assembly 350 can be disposed about the outer surface 334. The first slip assembly 350 can be disposed about the mandrel 332 and spacer ring 344 can provide an abutment which serves to axially retain the first slip assembly 350. Downhole tool 330 can have two slip assemblies 350, namely, a first slip assembly and second slip assembly. The slip assemblies 350 can anchor downhole tool 330 within well 305. Each slip assembly 350 can include slip 352 and one or more tapered surfaces 354. The slip 352 can be formed into an expandable ring.

One or more slip buttons or inserts 362 can be secured to the body of the slips 352 by adhesive, brazing, or by other means and the slip inserts 362 can extend radially outwardly from the outer slip surface 360. Slip inserts 362 can be machined and/or formed from cast iron, tungsten carbide, or other hardenable materials. The slip inserts 362 can be hardened to a Rockwell C hardness of from about 40 Rc to about 60 Rc or higher. The slip inserts 362 can be formed from ceramic materials. The slip inserts 362 can be formed from silicon nitride ($Si_3N_4$). slip inserts 362 can be, for example, formed from SN-235P from Kyocera.

Slip 352 can include a retaining ring 356 disposed in groove or grooves 358. Retaining ring 356 can retain slip 352 in an unset position about the outer surface 334 when downhole tool 330 might be lowered into the well 305. The slips 352 can be moved along one or more tapered surfaces 354 such that the slip inserts 362 and/or an outer slip surface 360 of the slips 352 can engage the casing 320 or wellbore 310. The slips 352 can be moved along the tapered surfaces 354 such that the slips 352 can be radially expanded from an unset to a set position, as depicted in FIG. 3 in which the first and second slips 352 engage casing 320 to hold downhole tool 330 in the well 305. The one or more tapered surfaces 354 can be disposed or otherwise formed about the outer surface 334. Retaining rings 356 can break or expand as slips 352 expand radially outwardly.

Slips 352 can be a drillable material and can be, for example, a molded phenolic and can have the outer slip surface 360. Slips 352 can be made from other drillable materials, for example slips 352 can be made from drillable metals, composites made with thermoplastics and/or thermoset resins, or engineering grade plastics. The remainder of the slip assembly 350 and other components of the tool may likewise be made from drillable materials.

At least one packer element assembly 364, can be disposed between tapered surfaces 354. The particular packer element assembly 364 is merely representative as there are other packer arrangements known and used in the art.

Figure 4:
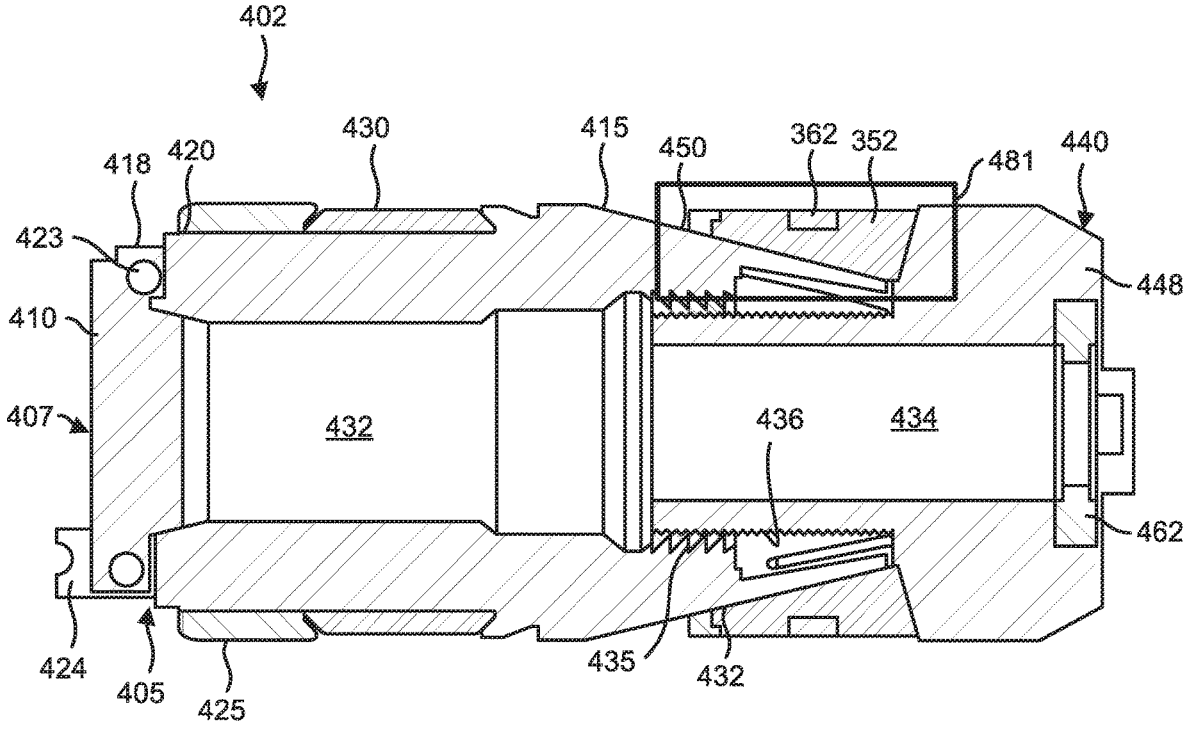
FIG. 4 depicts a cross-sectional view of an alternative downhole tool with slip, according to one or more embodiments disclosed.

FIG. 4 depicts a cross-sectional view of an alternative downhole tool with slip 352, according to one or more embodiments disclosed. The alternative downhole tool can be a fracture plug 402 that can include a fracture plug body 415 with a first sub 405 and a second sub 440. Alternative embodiments of the fracture plug 402 may instead include a plug body 415 having a single sub. The fracture plug 402 may further include the slip 352, a sealing element 425, a sealing element 430, a flapper valve 407, and a shear ring 462. The sealing elements 425, 430 are, in this particular example, constructed of a rubber and, more particularly, hydrogenated nitrile butadiene ("HNBR") rubber. The sealing elements 425, 430 provide a seal between the first sub 405 and the inner diameter of the casing 320, shown in FIG. 3, when the fracture plug 402 is in use.

The first sub 405, the second sub 440, or both may be cast, formed from a powdered metal, formed from a composite material, or include any combination thereof. In some embodiments, the fracture plug 402 may include a first sub 405 and a second sub 440 that are different materials, such as a cast first sub 405 and a composite second sub 440. When assembled, the first sub 405 may be partially disposed within the second sub 440. Further embodiments (not shown) of the fracture plug 402 may include a single plug body 415 that includes a metal core bonded, threadably engaged, or otherwise coupled to an outer sleeve.

In the illustrated embodiment, the slip 352 is disposed between the first and second subs 405, 440 of the fracture plug 402. A portion of the outer surface 450 of the first sub 405 can be tapered. The slip 352 may include a tapered inner surface 432. The inner surface 432 can contact the tapered outer surface 450. The slip 352 may be disposed about the outer surface 450 of the first sub 405 or about an outer surface, not shown, of the second sub 440 of the fracture plug. The slip 352 may be disposed about the outer surface of any downhole tool.

The flapper valve 407 may include a valve body 424, a rotatable arm 418, and a flapper 410. The valve body 424 may be coupled to the first sub 405 through an interference fit, interfacing threads, or other similar means. The rotatable arm 418 may couple the flapper 410 to the valve body 424. As shown in the exemplary embodiment, the rotatable arm 418 may be integrally formed with the flapper 410. Other embodiments may include a rotatable arm 418 that is coupled to the flapper 410 using fasteners, adhesives, welding, or other similar means.

A hinge 423 may allow the rotatable arm 418 to rotate about the valve body 424, opening and closing the flapper valve 407. In the closed position, shown in FIG. 4, the flapper 410 contacts and seals against the valve body 424, preventing fluid from flowing through a bore 432 of the fracture plug 402. In another embodiment, the flapper 410 may contact and seal against the first sub 405 to prevent fluid from flowing through the bore 432 of the fracture plug 402. In the open position, not shown, the flapper 410 does not contact the valve body 424, allowing fluid to pass through the fracture plug 402.

The flapper 410, rotatable arm 418, valve body 424, or any combination thereof may be made of dissolvable materials. The flapper 410 and rotatable arm 418, for example, may be made of a dissolvable rubber or plastic and valve body 424 may be made of a rigid dissolvable material. Other embodiments of the flapper valve 407 may be made of other dissolvable materials know in the industry. At least one embodiment of the fracture plug 402 may include a rotatable arm 418 that is directly coupled to the first sub 405, omitting the valve body 424. In such an embodiment, the rotatable arm 418 and flapper 410 may be made of a dissolvable material.

The fracture plug 402 may further include a shear ring 462. The shear ring 462 may be coupled to the second sub 440 through an interference fit, interfacing threads, or other similar means. In one embodiment, the shear ring 462 may be made of a dissolvable material. The shear ring 462 can be made from brass, composite material, dissolvable material, or any other material that will allow at least a portion of the shear ring 462 to be sheared away from its installed location. Other embodiments of the shear ring 462 may be made of a powdered metal, cast iron, or composite material. After a period of time, the flapper valve 407 may dissolve, allowing fluid to pass through the bore 432.

The second sub 440 includes a body 415 defining a bore 434 that, in conjunction with the bore 432 of the first sub 405 forms a bore through the body of the fracture plug 402. The first sub 405 defines a split ring 435 that engages the second sub 440 through a plurality of threads 436 on the second sub 440 to form a ratchet as the first sub 405 engages the second sub 440.

Figure 5:
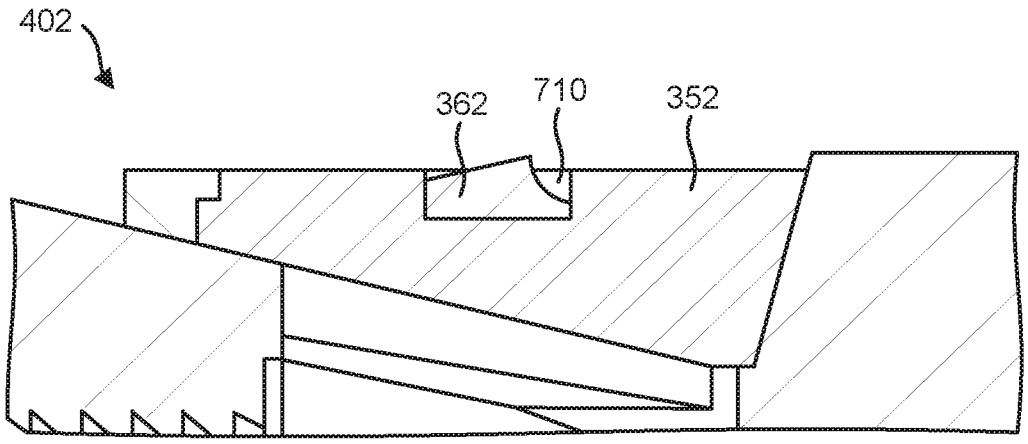
FIG. 5 depicts a section view of the portion of the downhole tool indicated by the detail labeled 481 in FIG. 4, according to one or more embodiments disclosed.

FIG. 5 depicts a section view of the fracture plug 402 indicated by the detail labeled 481 in FIG. 4, according to one or more embodiments disclosed. As depicted, the slip 352 is shown with insert 362 installed within a cavity 710 formed within the slip 352.

Figure 6:
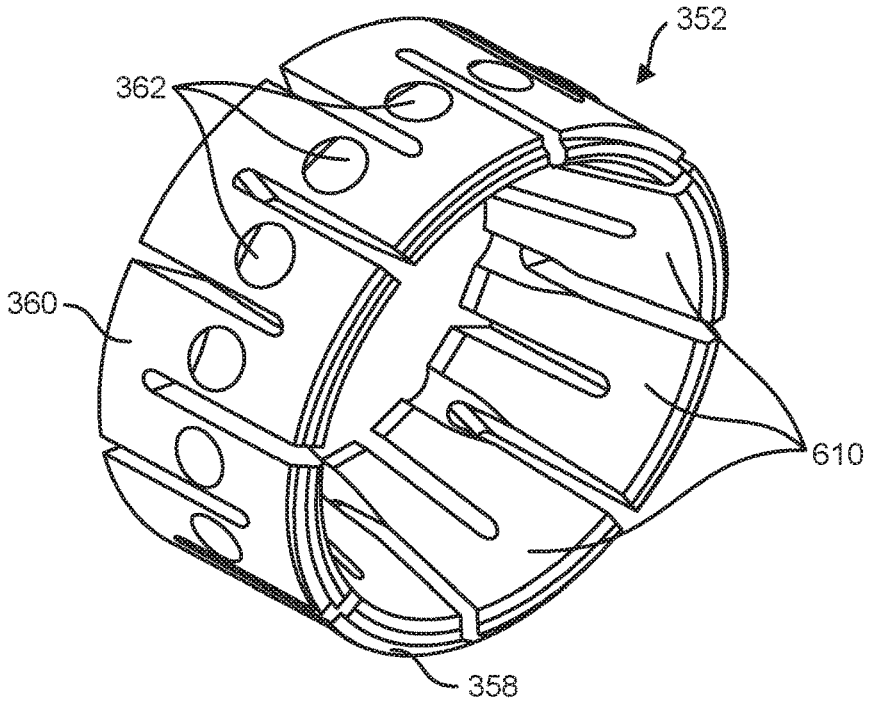
FIG. 6 depicts the slip with inserts installed therein, according to one or more embodiments disclosed.

FIG. 6 depicts the slip 352 with inserts 362 installed therein, according to one or more embodiments disclosed. In one or more embodiments, the slip 352 can include a plurality of slip segments 610 that can encircle a mandrel, for example mandrel 332 depicted in FIG. 3, can encircle the first sub 405 as depicted in FIG. 4, or can encircle the second sub 440, not shown. The plurality of slip segments 610 can be joined as depicted in FIG. 6, can be joined in any configuration, or can be separate slip segments 610, not shown. The one or more slip segments 610 can be disposed about mandrel 332, the first sub 405, the second sub 440, or about an outer surface of any downhole tool. The one or more slip segments can be disposed about one or more tapered surfaces formed on or otherwise disposed on the outer surface of any downhole tool.

In operation, the slip segments 610 can expand outwardly along the tapered surface 354 or along the tapered outer surface 450, shown in FIG. 4. Returning to FIG. 6, one or more inserts 362 can be secured to at least one of the slip segments 610 and the inserts 362 can extend outwardly from the outer slip surface 360. In one or more embodiments, a portion of the slip insert extending outwardly from the outer surface 360 of the slip segment 610 can be integrally designed into the slip segments 610, not shown, such that the insert 362 and the slip segment 610 can be formed as one part.

Figure 7:
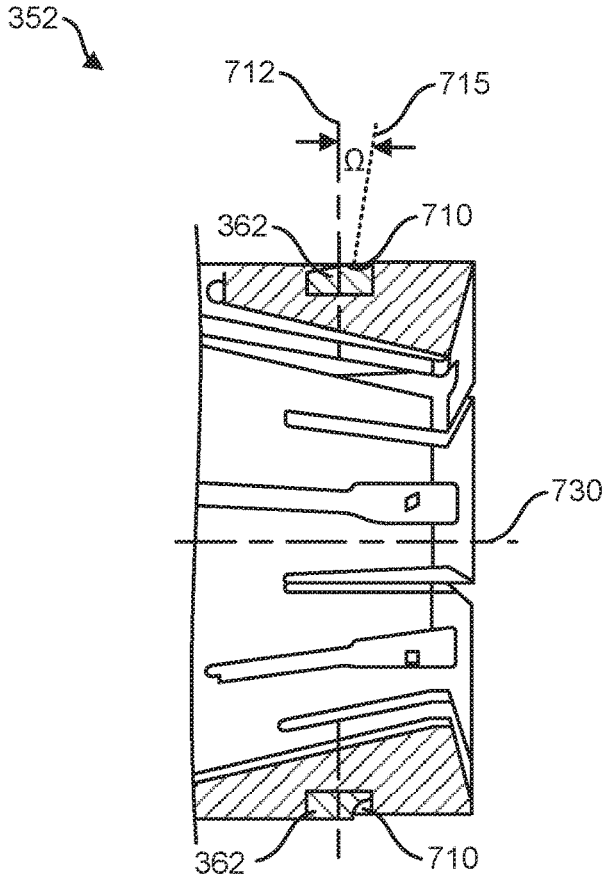
FIG. 7 depicts a section view of the slip, according to one or more embodiments disclosed.

FIG. 7 depicts a section view of the slip 352, according to one or more embodiments disclosed. In one or more embodiments, each insert 362 can include a central insert axis 715 and each can be secured in a cavity 710. The total number of inserts 362 secured to the slip 352 can be fewer or greater than the number depicted. The installed orientation of the inserts 362 can be such that when the slip 352 is set against a surface (e.g., casing 320), the inserts 362 can grippingly engage the surface upon which they are set. Each insert 362 can be secured within the cavity 710 at an insert installation angle Ω measured between a slip axis 712 perpendicular to a slip longitudinal axis 730 and the central insert axis 715. The insert installation angle Ω can be equal to about zero degrees. The insert installation angle Ω can be selected from a range of angles from about zero degrees to about fifty-degrees or greater. When the insert installation angle Ω is equal to zero degrees, the orientation of the secured insert 362 can be about perpendicular to the slip longitudinal axis 730.

Figure 8:
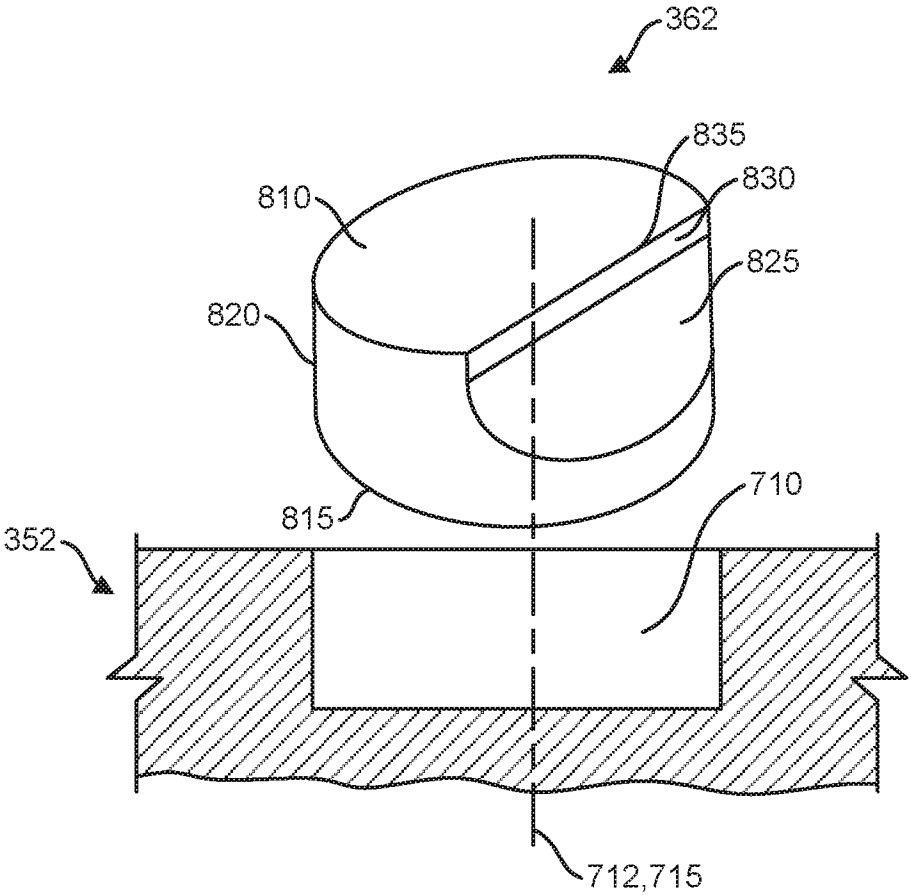
FIG. 8 depicts an orthographic view of the insert above the cavity, according to one or more embodiments disclosed.
Figure 13:
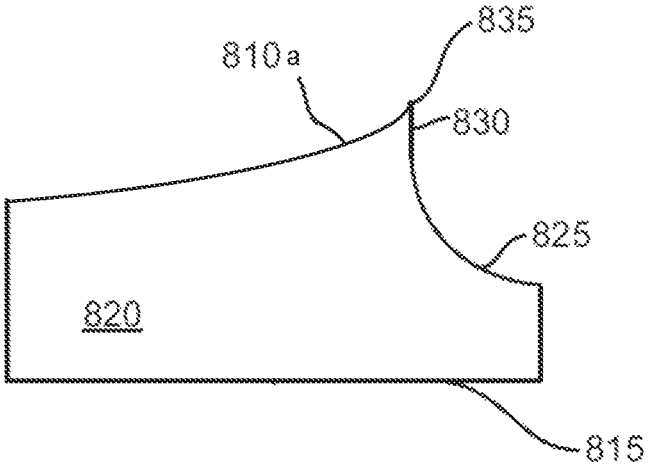
FIG. 13 depicts a side view of an insert in which an edge is formed between an intersection of a first curved surface and a two-dimensional planar surface extending from a concave surface.

FIG. 8 depicts an orthographic view of the insert 362 above the cavity 710, according to one or more embodiments disclosed. As shown, the insert 362 central insert axis 715 is aligned with slip axis 712 which can be the axis through which insert 362 is installed within the cavity 710. The insert 362 can have a bottom 815, a cylindrical outer surface 820, and an edge 835 formed by a first two-dimensional planar surface 810 intersected by a second two-dimensional planar surface 830 extending from a three-dimensional concave surface 825. In one or more embodiments, the three-dimensional concave surface 825 can intersect the first two-dimensional planar surface 810, forming the edge 835. The first two-dimensional planar surface 810 can be a three-dimensional surface and/or can be curved along at least a portion of its surface. The first two-dimensional planar surface 810 can be or include a first curved surface, such as the first curved surface 810*a* shown in FIG. 13. In one or more embodiments, insert 362 can be cylindrically shaped as shown or can be any geometric shape sized appropriately to fit within the cavity 710.

Figure 9:
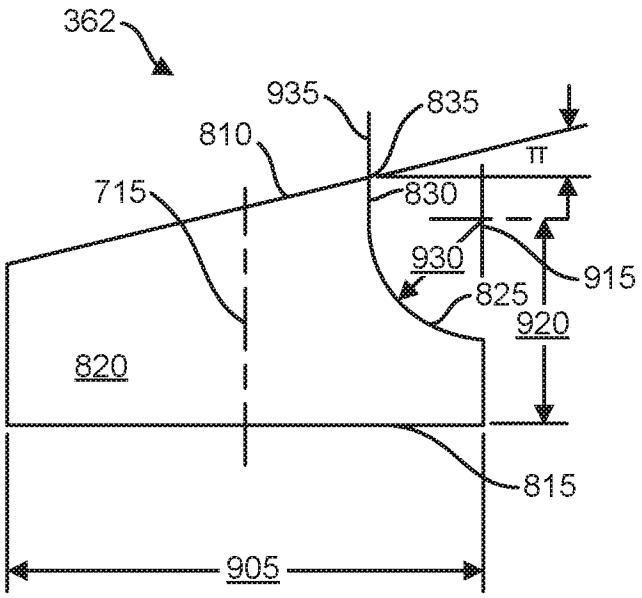
FIG. 9 depicts a side view of the insert, according to one or more embodiments disclosed.

FIG. 9 depicts a side view of the insert 362, according to one or more embodiments disclosed. The insert 362 can be cylindrically shaped have a diameter 905. The three-dimensional concave surface 825 can be a formed with a radius 930. The center of the arc of the radius 930 can extend from an intersection point 915 located at height 920 above the bottom 815. The first two-dimensional planar surface 810 can be formed at an angle τ measured between a line parallel to the bottom 815 and a line extending from the two-dimensional planar surface 810. The second two-dimensional surface 830 can be formed parallel, as shown by a line 935 extending form the second two-dimensional surface 830, to central insert axis 715 or at some angle measured between from about zero degrees to about one hundred and eighty degrees to the parallel 935.

Figure 10:
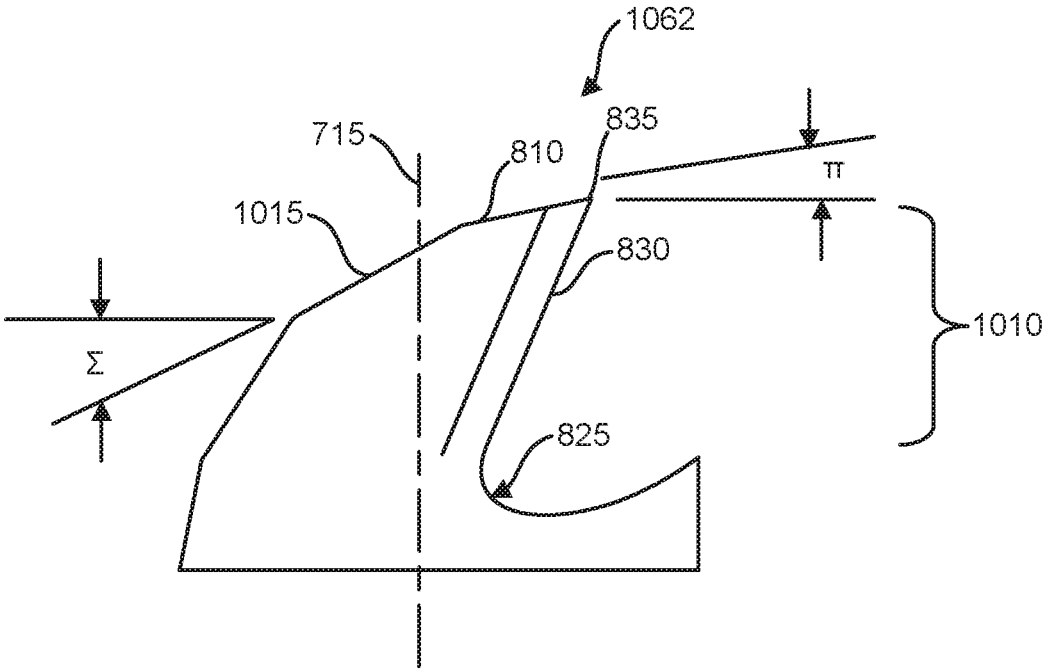
FIG. 10 depicts a side view of an alternative insert, according to one or more embodiments disclosed.

FIG. 10 depicts a side view of an alternative insert 1062, according to one or more embodiments disclosed. The insert 1062 can be formed with the characteristics of a milling tool cutting edge. The second two-dimensional surface 830 and the edge 835 can form a cutting edge or tooth face 1010. In one or more embodiments, the concave surface 825 can be formed along a radius similar to the radius 930 from FIG. 9 or can be formed along an irregular curve as depicted or any can be any shape. The concave surface 825 and the edge 835 can form the cutting edge 1010. The first two-dimensional planar surface 810 can be formed at the angle τ, similar to a cutting tool primary clearance angle which can be a relief adjacent to the cutting edge 1010. The surface 1015 can be formed similar to a cutting tool secondary clearance angle Σ. The concave surface 825 can be similar to a cutting tool hook. The cutting tool hook refers to a concave surface of a cutting tool tooth face.

Figure 11:
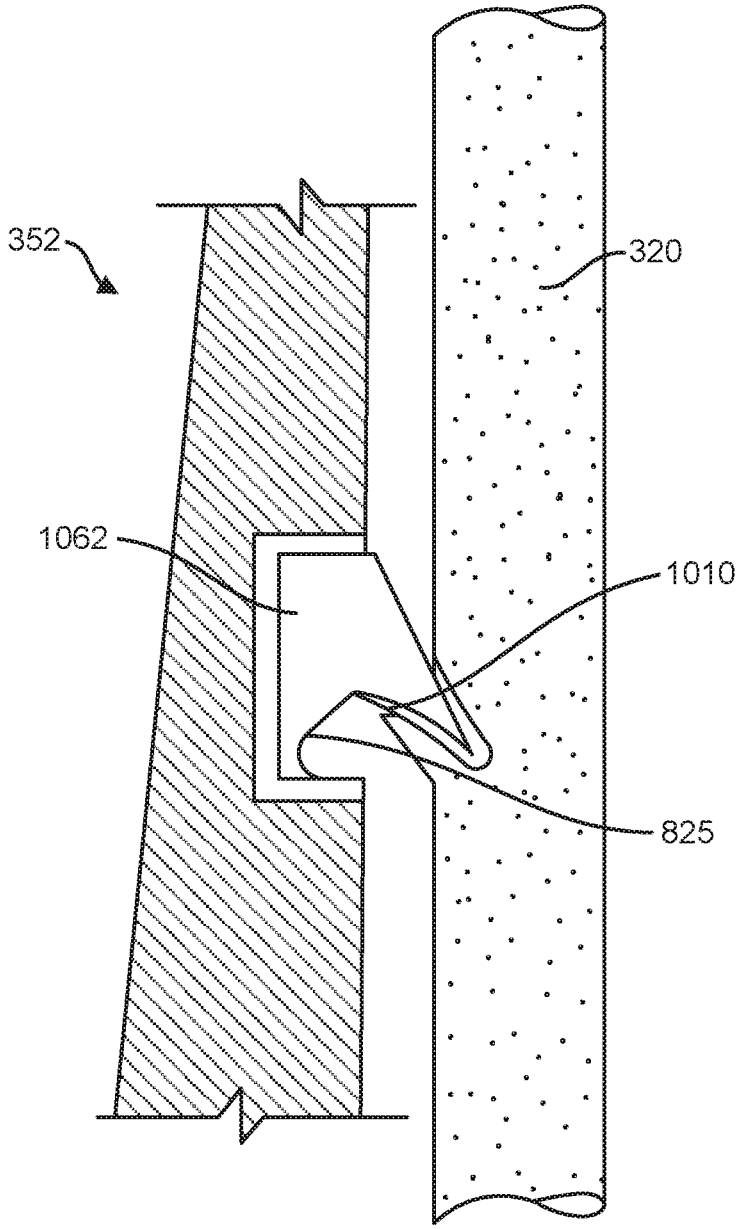
FIG. 11 depicts the insert engaged with the casing, according to one or more embodiments disclosed.

FIG. 11 depicts the insert 1062 engaged with the casing 320, according to one or more embodiments disclosed. The shape of the concave surface 825 and/or the cutting surface 1010 can provide increased surface area within the insert 1062 for securing the insert 1062 within the casing 320. In tests, the shape of the concave surface 825 and/or the cutting surface 1010 formed on a test insert 1062 provided surprisingly better gripping action between the insert 1062 and a test casing over conventional insert designs. Without being bound by theory, it is surmised from the testing data that the one or more insert 1062 form factors described herein provides increased contact area between the insert 362 and the casing 320 and can be the reason for the resultant improved gripping action.

Figure 12A:
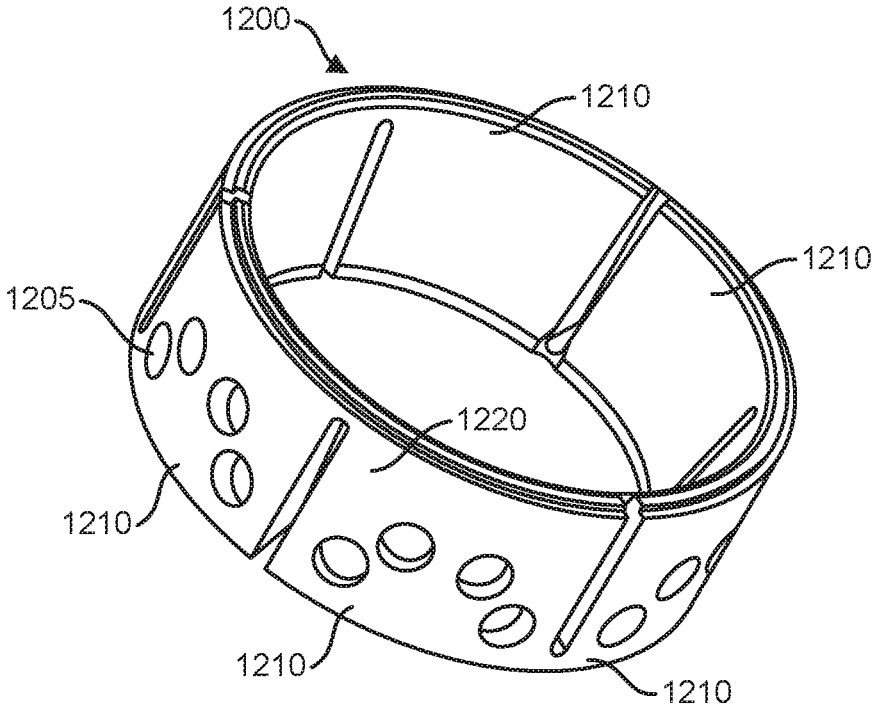
Figure 12B:
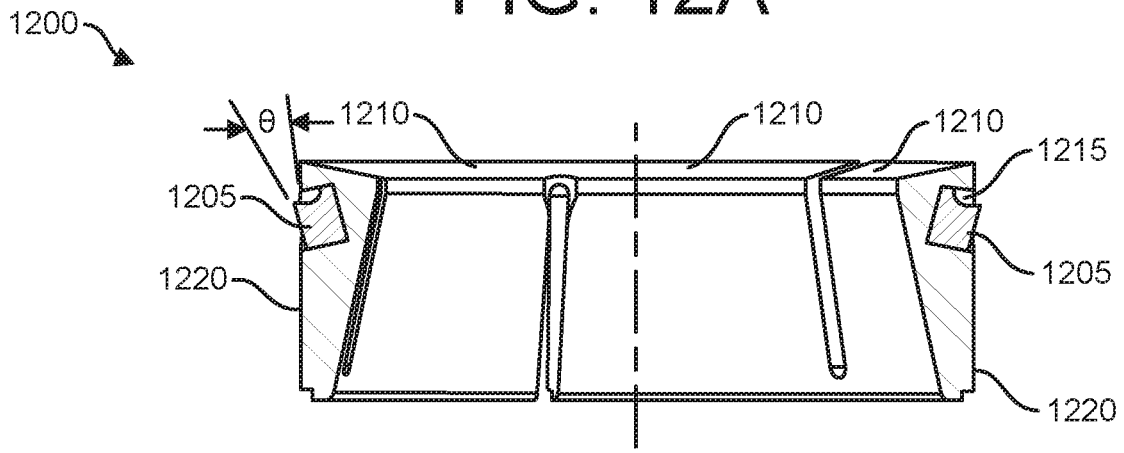
Figure 12C:
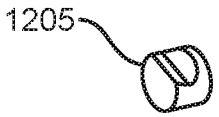

FIGS. 12A-12C illustrate another embodiment of a slip 1200. FIG. 12A is a perspective view of the slip 1200 and FIG. 12B a sectioned view while FIG. 12C depicts an insert 1205 in isolation from the rest of the slip 1200. The slip 1200 is similar in operation and construction to those embodiments described above. Note, however, that the number of inserts 1205 differs in aggregate number, in distribution across the slip 1200, and in the number of inserts 1205 per slip segment 1210. (Only one insert 1205 is indicated in FIG. 12A.) The inserts 1205 are set in a cavity 1215 (only one indicated) defined by the slip segments 1210 such that the inserts 1205 are oriented at an angle $\theta < 90°$ relative to the outer slip surface 1220 of the slip segments 1210.

Angling the inserts 1205 in this manner puts the component that the slip 1200 is setting into compression rather than shear. Conversely, in embodiments in which the inserts include inserts at 90° relative to the outer slip surface, the component being set is being set into shear. The value of the angle θ will be implementation specific depending on the parameters of any particular setting for which the slip 1200 is intended to implement.

The foregoing has outlined features of several embodiments so that those skilled in the art can better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A slip insert secured to a slip segment, comprising:

the slip insert defining a concave surface formed therein and an edge formed between an intersection of a first two-dimensional planar surface and a second two-dimensional planar surface extending from the concave surface.

2. The slip insert of claim 1, wherein the slip insert is machined from hardenable material.

3. A fracture plug, comprising:

a fracture plug body including a first sub, the first sub having an outer surface;

a slip disposed about the outer surface of the first sub; and one or more slip inserts, secured to one or more slip segments, the slip insert having a concave surface formed therein and an edge formed between an intersection of a first two-dimensional planar surface and a second two-dimensional planar surface extending from the concave surface.

4. The fracture plug of claim 3, further comprising a second sub wherein the first sub is at least partially disposed within the second sub and the slip is disposed between the first sub and the second subs.

5. The fracture plug of claim 3, wherein the one or more slip inserts are machined from hardenable material.

6. The fracture plug of claim 3, further comprising a flapper coupled to the plug body, the flapper configured to seal a bore of the plug body.

7. The fracture plug of claim 6, wherein the flapper comprises a dissolvable material.

8. A downhole tool comprising:

a first slip having one or more first slip segments disposed about one or more first tapered surfaces on an outer surface of the downhole tool, and one or more slip inserts, secured to at least one of the first slip segments, the slip inserts having a concave surface formed therein and an edge formed between an intersection of a first two-dimensional planar surface and a second two-dimensional planar surface extending from the concave surface.

9. The downhole tool of claim 8, further comprising:

a second slip having one or more second slip segments disposed about one or more second tapered surfaces on the outer surface of the downhole tool, and one or more slip inserts, secured to at least one of the second slip segments, the slip inserts having a concave surface formed therein.

10. The downhole tool of claim 8, wherein the slip inserts are machined from hardenable material.

11. A slip insert secured to a slip segment comprising:

the slip insert having a concave surface formed therein and an edge formed between an intersection of a first curved surface and a two-dimensional planar surface extending from the concave surface.

12. The slip insert of claim 11, wherein the slip insert is machined from hardenable material.

13. A fracture plug comprising:

a fracture plug body having a first sub, a slip disposed about an outer surface of the first sub, and one or more slip inserts, secured to one or more slip segments, the slip insert having a concave surface formed therein and an edge formed between an intersection of a first curved surface and a two-dimensional planar surface extending from the concave surface.

14. The fracture plug of claim 13, further comprising a second sub wherein the first sub is at least partially disposed within the second sub and the slip is disposed between the first sub and the second subs.

15. The fracture plug of claim 13, wherein the one or more slip inserts are machined from hardenable material.

16. The fracture plug of claim 13, further comprising a flapper coupled to the plug body, the flapper configured to seal a bore of the plug body.

17. The fracture plug of claim 16, wherein the flapper comprises a dissolvable material.

18. A downhole tool, comprising:

a first slip having one or more first slip segments disposed about one or more first tapered surfaces on an outer surface of the downhole tool, and one or more slip inserts, secured to at least one of the first slip segments, the slip inserts having a concave surface formed therein and an edge formed between an intersection of a first curved surface and a two-dimensional planar surface extending from the concave surface.

19. The downhole tool of claim 18, further comprising:

a second slip having one or more second slip segments disposed about one or more second tapered surfaces on the outer surface of the downhole tool; and one or more slip inserts, secured to at least one of the second slip segments, the slip inserts having a concave surface formed therein.

20. The slip insert of claim 18, wherein the slip insert is machined from hardenable material.

* * * * *